US010297241B2

(12) United States Patent
Sasai

(10) Patent No.: US 10,297,241 B2
(45) Date of Patent: May 21, 2019

(54) SOUND SIGNAL PROCESSING METHOD AND SOUND SIGNAL PROCESSING APPARATUS

(71) Applicant: YAMAHA CORPORATION, Shizuoka (JP)

(72) Inventor: Dan Sasai, Shizuoka (JP)

(73) Assignee: YAMAHA CORPORATION, Shizuoka (JP)

( * ) Notice: Subject to any disclaimer, the term of this patent is extended or adjusted under 35 U.S.C. 154(b) by 0 days.

(21) Appl. No.: 16/123,478

(22) Filed: Sep. 6, 2018

(65) Prior Publication Data

US 2019/0005935 A1 Jan. 3, 2019

Related U.S. Application Data

(63) Continuation-in-part of application No. PCT/JP2017/009074, filed on Mar. 7, 2017.

(30) Foreign Application Priority Data

Mar. 7, 2016 (JP) ..... 2016-043219

(51) Int. Cl.
*G10H 7/00* (2006.01)
*G10H 1/40* (2006.01)
(Continued)

(52) U.S. Cl.
CPC ..... *G10H 1/40* (2013.01); *G10G 3/04* (2013.01); *G10H 1/0008* (2013.01); *G10L 25/27* (2013.01);
(Continued)

(58) Field of Classification Search
CPC .. G10H 1/40; G10H 1/0008; G10H 2210/071; G10H 2210/076; G10L 25/51; G10L 25/54; G10L 25/27; G10G 3/04
(Continued)

(56) References Cited

U.S. PATENT DOCUMENTS 6,542,869 B1 * 4/2003 Foote ..... G06F 17/30743 704/200.1
9,245,508 B2 * 1/2016 Sugano ..... G10H 1/40
(Continued)

FOREIGN PATENT DOCUMENTS

EP 2375407 A1 10/2011
JP 2003-330460 A 11/2003
(Continued)

OTHER PUBLICATIONS

Paris Smaragdis et al., "Supervised and Semi-supervised Separation of Sounds from Single-Channel Mixtures" In: ICA. 2007. p. 414-421.

(Continued)

*Primary Examiner* — Jeffrey Donels
(74) *Attorney, Agent, or Firm* — Chip Law Group

(57) ABSTRACT

A sound signal processing method according to an embodiment includes a step of acquiring an input sound signal, a step of acquiring a beat number per unit time period from the input sound signal, a step of normalizing the input sound signal with the beat number per unit time period, a step of calculating a beat spectrum of the normalized input sound signal, and a step of calculating a rhythm similarity between the beat spectrum of the normalized input sound signal and a normalized beat spectrum calculated from a reference sound signal.

8 Claims, 10 Drawing Sheets

(51) Int. Cl.

| | |
|---|---|
| ***G10H 1/00*** | (2006.01) |
| ***G10L 25/51*** | (2013.01) |
| ***G10G 3/04*** | (2006.01) |
| ***G10L 25/27*** | (2013.01) |
| ***G10L 25/54*** | (2013.01) |

(52) U.S. Cl.
CPC ..... *G10L 25/51* (2013.01); *G10L 25/54* (2013.01); *G10H 2210/071* (2013.01); *G10H 2210/076* (2013.01)

(58) Field of Classification Search
USPC ..... 84/612
See application file for complete search history.

(56) References Cited

U.S. PATENT DOCUMENTS

| | | | | |
|---|---|---|---|---|
| 9,378,768 | B2 * | 6/2016 | Wu | G06F 17/30778 |
| 2003/0205124 | A1 * | 11/2003 | Foote | G10G 1/00 84/608 |
| 2008/0072741 | A1 * | 3/2008 | Ellis | G10H 1/0008 84/609 |
| 2011/0271819 | A1 * | 11/2011 | Arimoto | G10H 1/40 84/611 |
| 2013/0064379 | A1 * | 3/2013 | Pardo | H04S 7/40 381/56 |

FOREIGN PATENT DOCUMENTS

| | | | |
|---|---|---|---|
| JP | 2008-275975 | A | 11/2008 |
| JP | 2011-221156 | A | 11/2011 |
| JP | 2015-79110 | A | 4/2015 |
| JP | 2015-114361 | A | 6/2015 |

OTHER PUBLICATIONS

Daniel D. Lee et al., "Algorithms for non-negative matrix factorization" Advances in neural information processing systems, 13(1) V621-V624, 2001, pp. 7.

International Search Report and Written Opinion of PCT Application No. PCT/JP2017/009074, dated May 30, 2017, 02 pages of English Translation and 07 pages of ISRWO.

Shota Kawabuchi et al., "NMF O Riyo shita Gakkyokukan Ruiji Shakudo no Kosei Hoho nl Kansuru Kento", Report of the 2011 Spring Meeting, the Acoustical Society of Japan CDROM [CD-ROM], Mar. 2, 2011, pp. 1035 to 1036, 3-1-4.

Foote et al., "The Beat Spectrum: A New Approach to Rhythm Analysis", 2001 IEEE International Conference on Multimedia and Expo, Oct. 20, 2003, pp. 1088-1091.

* cited by examiner

FIG. 15A INPUT SOUND
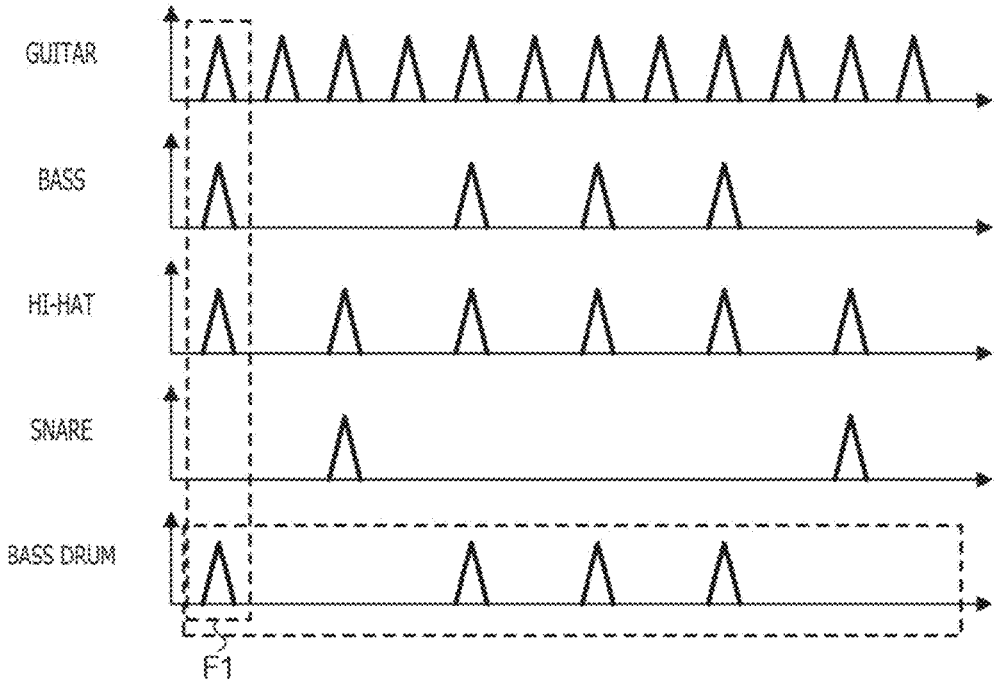
FIG. 15B REFERENCE SOUND
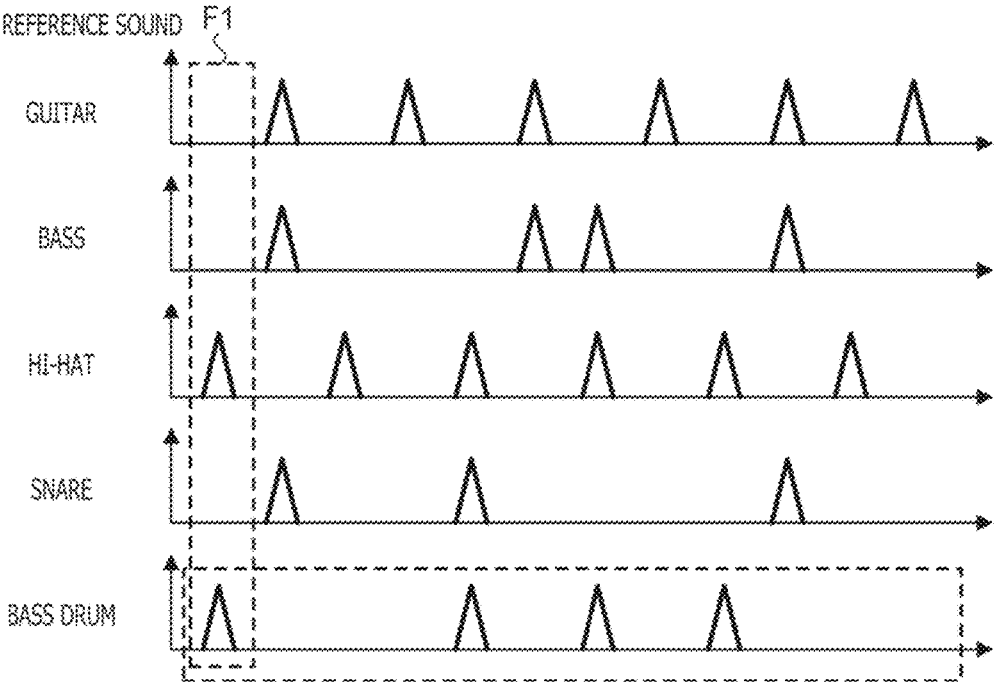

SOUND SIGNAL PROCESSING METHOD AND SOUND SIGNAL PROCESSING APPARATUS

CROSS-REFERENCE TO RELATED APPLICATIONS

This application is a continuation-in-part application of International Application No. PCT/JP2017/009074, filed Mar. 7, 2017, which claims priority to Japanese Patent Application No. 2016-043219 filed in Japan on Mar. 7, 2016. The entire disclosures of International Application No. PCT/JP2017/009074 and Japanese Patent Application No. 2016-043219 are hereby incorporated herein by reference.

BACKGROUND

Technical Field

The present invention relates to a technology for analyzing a sound signal of a musical piece.

Background Art

Various technologies have been proposed for analyzing a sound signal of a musical piece is known. For example, Japan Laid-Open Patent Application No. 2015-79110 (hereinafter referred to as Patent Document 1) describes a technology for analyzing a genre or a style of a musical piece using nonnegative matrix factorization (NMF).

SUMMARY

A sound signal processing method in accordance with some embodiments including acquiring a beat number per unit time period from an input sound signal, executing a normalization process for normalizing the input sound signal with the beat number per unit time period, calculating a rhythm similarity between the beat spectrum of the normalized input sound signal and a normalized beat spectrum calculated from a reference sound signal.

A sound signal processing apparatus in accordance with some embodiments including an information processing apparatus having an acquisition unit, a beat number acquisition unit, a normalization unit, a beat spectrum calculation unit and a rhythm similarity calculation unit; the acquisition unit being configured to acquire an input sound signal; the beat number acquisition unit being configured to acquire a beat number per unit time period from the input sound signal; the normalization unit being configured to normalize the input sound signal with the beat number per unit time period; the beat spectrum calculation unit being configured to calculate a beat spectrum of the normalized input sound signal; and the rhythm similarity calculation unit being configured to calculate a rhythm similarity between the beat spectrum of the normalized input sound signal and a normalized beat spectrum calculated from a reference sound signal.

BRIEF DESCRIPTION OF DRAWINGS

FIGS. 15A and 15B are a view illustrating a combination of bases.

DESCRIPTION OF EMBODIMENT

In conventional systems, there is a possibility that analyzing a rhythm pattern using NMF fails to analyze a detailed rhythm patterns. In view of the above circumstances, it is an object of some embodiments to analyze a detailed rhythm pattern.

Selected embodiments will now be explained with reference to the drawings. It will be apparent to those skilled in the sound field from this disclosure that the following descriptions of the embodiments are provided for illustration only and not for the purpose of limiting the invention as defined by the appended claims and their equivalents.

1. Configuration

Figure 1:
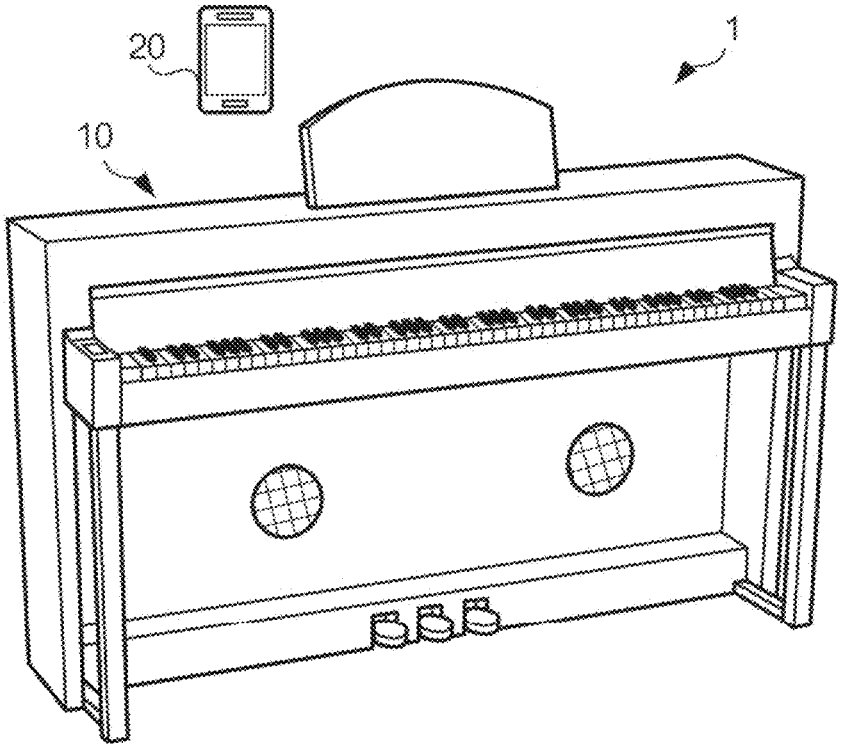
FIG. 1 is a view illustrating a musical piece search system 1.

FIG. 1 is a view illustrating a musical piece search system 1. The musical piece search system 1 has a plurality of musical piece data stored in advance therein. If an input of sound of a musical piece that becomes a processing target (musical piece that becomes a search key) is accepted (in the following description, this sound is referred to as "input sound," and a signal indicative of an input sound is referred to as "input sound signal"), then the musical piece search system 1 searches for a musical piece similar to the input sound from among the musical pieces stored therein.

In this example, the musical piece search system 1 includes a digital musical instrument 10 and an information processing apparatus 20. The digital musical instrument 10 is an example of a musical piece storage apparatus that stores musical piece data that become a search target. The information processing apparatus 20 is an example of a user terminal that provides a user interface. The musical piece data stored in the digital musical instrument are called data of musical pieces for accompaniment (such data are hereinafter referred to as "accompaniment data," and sound of a musical piece for accompaniment is referred to as "accompaniment sound"). A user would input information of a musical piece to be played by the user itself from now on to the information processing apparatus 20. Although the information of a musical piece is a sound signal of the musical piece based on sound data, for example, of a non-compressed or compressed format (way, mp3 or the like), it is not limited to any of them. Further, the information of musical pieces may be stored in advance in a storage 203 of the information processing apparatus 20 hereinafter described or may be input from the outside of the information processing apparatus 20. The information processing apparatus 20 searches the accompaniment data stored in the digital musical instrument for accompaniment data similar to the input musical piece. If accompaniment sound similar to the input musical piece is found out, then the information processing apparatus 20 instructs the digital musical instrument 10 to reproduce the accompaniment sound. The digital musical instrument 10 reproduces the instructed accompaniment sound. The user would play the digital musical instrument 10 in accordance with the reproduced accompaniment.

Figure 2:
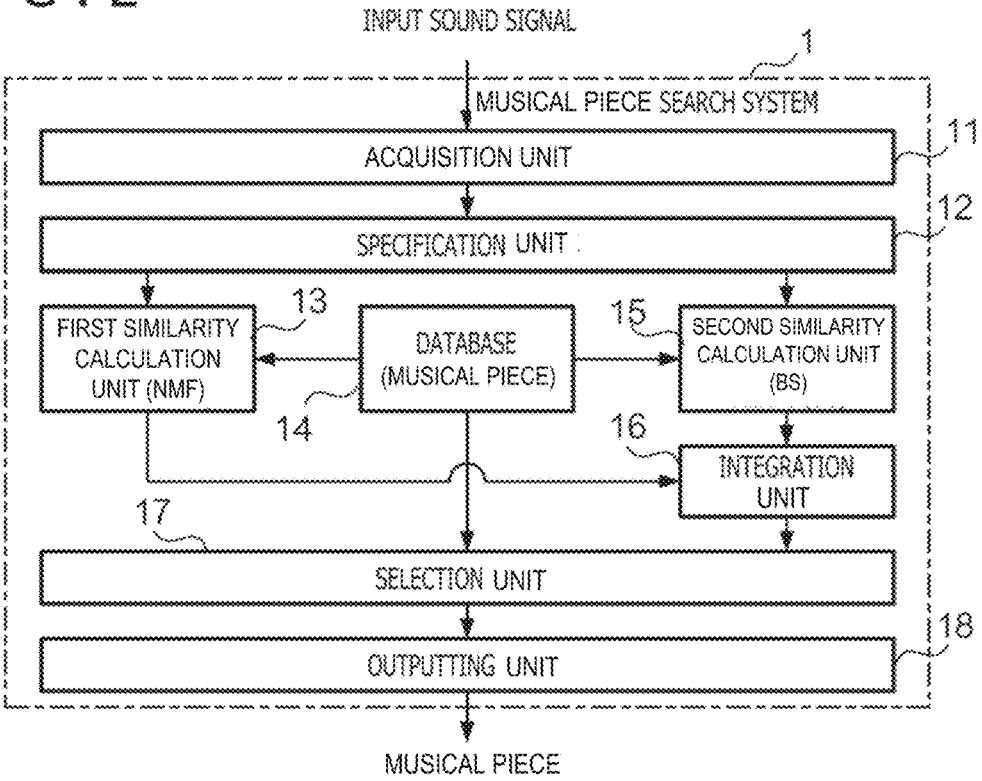
FIG. 2 is a block diagram of the musical piece search system 1.

FIG. 2 is a block diagram of the musical piece search system 1. If a sound signal of a musical piece (input sound signal) is input, then the musical piece search system 1 outputs a musical piece similar to the musical piece. The musical piece search system 1 includes acquisition unit 11, specification unit 12, first similarity calculation unit 13, a database 14, second similarity calculation unit 15, integration unit 16, selection unit 17, and outputting unit 18.

The acquisition unit 11 acquires an input sound signal. The specification unit 12 specifies a target section that becomes a target of later processing from within the input sound signal. The database 14 has stored therein information regarding a plurality of accompaniment data. The first similarity calculation unit 13 calculates, within the target section of the input sound signal, a similarity between the input sound and the accompaniment sound using nonnegative matrix factorization (NMF). The second similarity calculation unit 15 calculates a similarity between the input sound and the accompaniment sound using a beat spectrum within the target section of the input sound signal. The integration unit 16 integrates the similarity calculated by the first similarity calculation unit 13 and the similarity calculated by the second similarity calculation unit 15. The selection unit 17 selects a musical piece similar to the input sound from within the database 14 on the basis of the integrated similarity. The outputting unit 18 outputs the selected musical piece.

Figure 3:
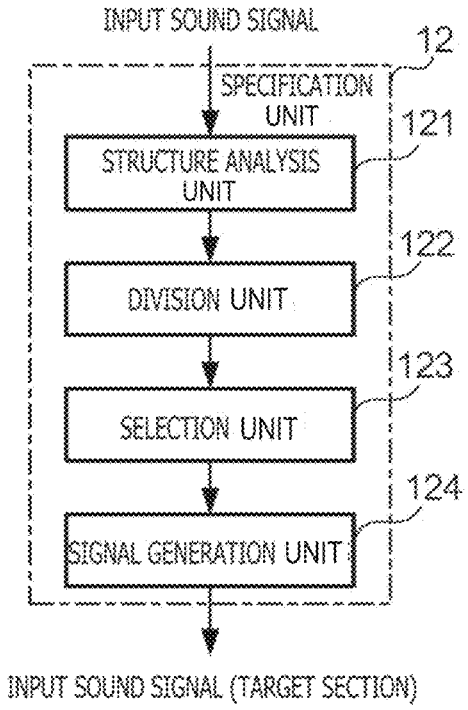
FIG. 3 is a block diagram of specification unit 12.

FIG. 3 is a block diagram of specification unit 12. The specification unit 12 outputs a sound signal after a portion other than a target section (such portion is hereinafter referred to as "non-target section") is removed from the input sound signal. The specification unit 12 includes structure analysis unit 121, division unit 122, selection unit 123, and signal generation unit 124. The structure analysis unit 121 performs analysis of a musical structure of a musical piece (such analysis is hereinafter referred to as "musical piece structure analysis") indicated by the input sound signal. The division unit 122 divides the input sound signal into a plurality of sections in the time domain in accordance with a result of the musical piece structure analysis. The selection unit 123 selects a section that becomes a target section from among the plurality of sections. The signal generation unit 124 generates a sound signal by removing the non-target section from the input sound signal, namely, a sound signal only of a target section.

Figure 4:
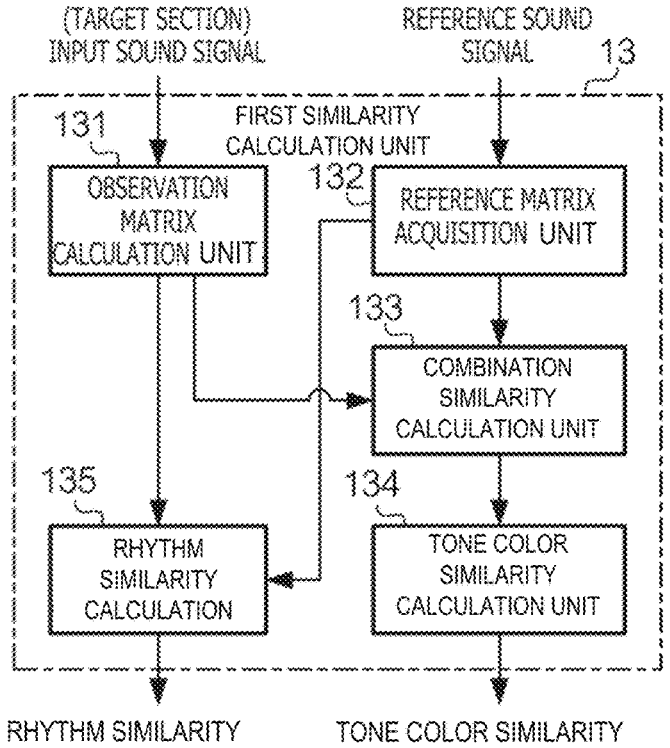
FIG. 4 is a block diagram of a first similarity calculation unit 13.

FIG. 4 is a block diagram of a first similarity calculation unit 13. The first similarity calculation unit 13 outputs a similarity regarding the tone color (hereinafter referred to as "tone color similarity") and a similarity regarding the rhythm (hereinafter referred to as "rhythm similarity") in regard to the input sound signal. The first similarity calculation unit 13 includes observation matrix calculation unit 131, reference matrix acquisition unit 132, combination similarity calculation unit 133, tone color similarity calculation unit 134, and rhythm similarity calculation unit 135. The observation matrix calculation unit 131 decomposes a matrix corresponding to an amplitude spectrogram of the input sound signal (such matrix is hereinafter referred to as "observation matrix") into the product of a basis matrix and an activation matrix (coefficient matrix) in accordance with a predetermined algorithm (in this example, the NMF. Details of the NMF are hereinafter described). In the following description, the basis matrix and the activation matrix obtained from the input sound signal are referred to as "observation basis matrix" and "observation activation matrix," respectively. The observation basis matrix corresponds to the amplitude spectrogram of the input sound signal and is an example of a first matrix including first components relating to a frequency and second components relating to time. The reference matrix acquisition unit 132 acquires the basis matrix and the activation matrix obtained by the NMF from a reference sound signal. In the following description, the basis matrix and the activation matrix obtained from the reference sound signal are referred to as "reference basis matrix" and "reference activation matrix," respectively. The reference sound signal is a sound signal indicating a musical piece for reference. The musical piece for reference is a musical piece indicated by one accompaniment data successively selected from among the accompaniment data recorded in the database 14. The reference basis matrix corresponds to an amplitude spectrogram of the reference sound signal and is an example of a second matrix that includes first components and second embodiments and is calculated in accordance with the predetermined algorithm described hereinabove. The combination similarity calculation unit 133 calculates a similarity between the observation basis matrix and a combination of bases included in the reference basis matrix for each unit period of time. The tone color similarity calculation unit 134 integrates the similarity calculated by the combination similarity calculation unit 133 in the time domain to calculate a tone color similarity between the input sound and the reference sound (the similarity is an example of a first similarity). The rhythm similarity calculation unit 135 calculates a similarity between the observation activation matrix and the reference activation matrix. This similarity indicates a rhythm similarity between the input sound and the reference sound (the similarity is an example of a second similarity).

Figure 5:
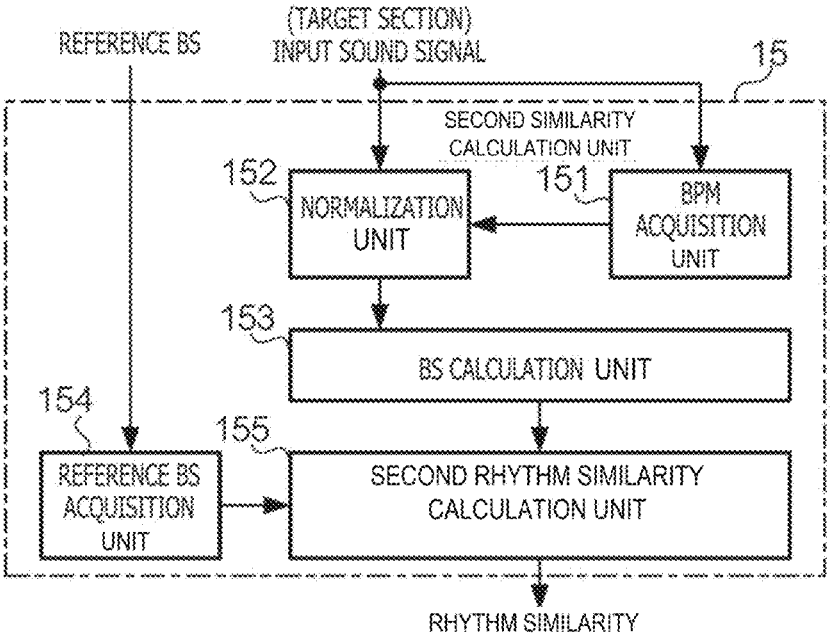
FIG. 5 is a block diagram of a second similarity calculation unit 15.

FIG. 5 is a block diagram of a second similarity calculation unit 15. The second similarity calculation unit 15 outputs a rhythm similarity calculated in accordance with an algorithm different from that of the first similarity calculation unit 13 in regard to the input sound signal. The second similarity calculation unit 15 includes BPM acquisition unit (beat number acquisition unit) 151, normalization unit 152, BS calculation unit (beat spectrum calculation unit) 153, reference BS acquisition unit 154, and second rhythm similarity calculation unit 155. The BPM acquisition unit 151 acquires BPM (Beats Per Minute) of the input sound signal, namely, a beat number per unit period of time. The normalization unit 152 normalizes the input sound signal with the BPM. Here, "to normalize the input sound signal with the BPM" includes not only direct normalization of the input sound signal with the BPM but also normalization of a signal obtained by performing some signal processing for the input sound signal with the BPM. The BS calculation unit 153

(one example of first calculation unit) calculates a beat spectrum of the normalized input sound signal. The reference BS acquisition unit 154 acquires the normalized beat spectrum obtained from the reference sound signal. The second rhythm similarity calculation unit 155 (one example of second calculation unit) compares the normalized beat spectrum of the input sound signal and the normalized beat spectrum of the reference sound signal to calculate a rhythm similarity between the input sound and the reference sound.

Figure 6:
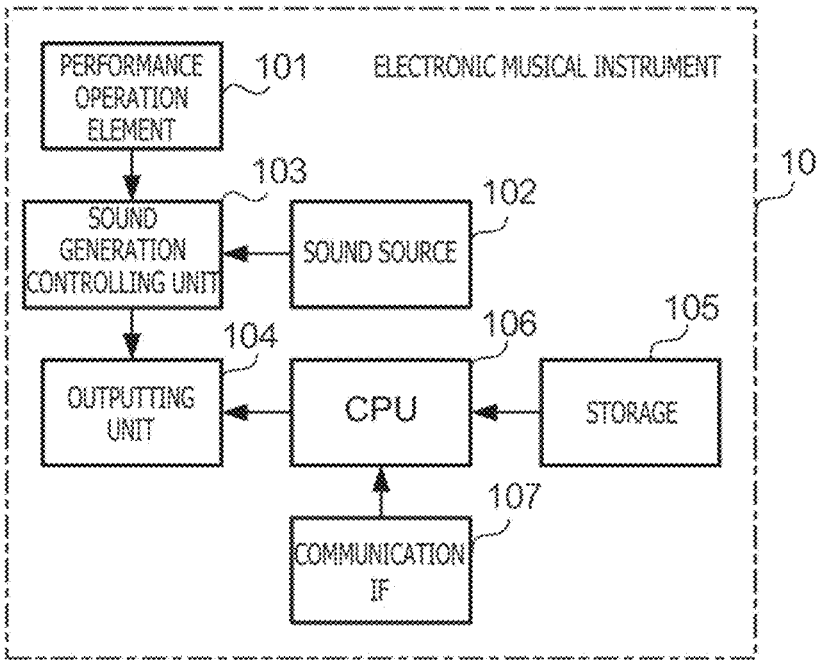
FIG. 6 is a block diagram of a digital musical instrument 10

FIG. 6 is a block diagram of digital musical instrument 10. The digital musical instrument 10 includes a performance operation element 101, a sound source 102, a sound generation controlling unit 103, an outputting unit 104, a storage 105, a central processing unit (CPU) 106, and a communication interface (IF) 107. The performance operation element 101 is an operation element used for a performance operation by a user (performer), for example, a keyboard in a keyboard instrument, a string in a string instrument, or a key in a wind instrument. The sound source 102 has stored therein sound data corresponding to each performance operation element. For example, in a keyboard instrument, sound data corresponding to a certain key is data indicative of a sound waveform from the rising until disappearing of sound that is generated when the key is pressed. The sound generation controlling unit 103 reads out sound data from the sound source 102 in response to an operation of the performance operation element 101. The outputting unit 104 outputs a sound signal according to the read out data (such signal is hereinafter referred to as "performance sound signal"). The storage 105 is a nonvolatile storage apparatus for storing data. The data stored in the storage 105 include a database in which a plurality of accompaniment data are recorded. The CPU 106 is a control apparatus for controlling the components of the digital musical instrument 10. The CPU 106 supplies accompaniment data read out from the storage 105 to the outputting unit 104. The outputting unit 104 is an outputting apparatus that outputs a sound signal according to the accompaniment data (such signal is hereinafter referred to as "accompaniment sound signal") in addition to the performance sound signal and includes, for example, a speaker. The communication IF 107 is an interface for communicating with a different apparatus, in the present apparatus, especially with the information processing apparatus 20. The communication IF 107 communicates with the information processing apparatus 20 by wireless communication, for example, in accordance with a predetermined standard.

Figure 7:
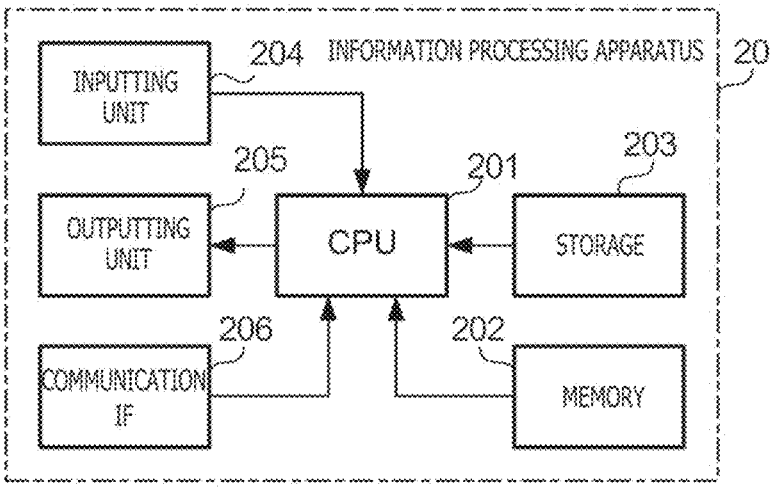
FIG. 7 is a block diagram of an information processing apparatus 20.

FIG. 7 is a block diagram of an information processing apparatus 20. The information processing apparatus 20 is a computer apparatus that functions as a user terminal, for example, a smartphone. The information processing apparatus 20 includes a CPU 201, a memory 202, a storage 203, an inputting unit 204, an outputting unit 205, and a communication IF 206. The CPU 201 is a control apparatus for controlling the other components of the information processing apparatus 20. The memory 202 is a volatile storage apparatus that functions as workspace when the CPU 201 executes a program. The storage 203 is a nonvolatile storage apparatus in which various data and programs are stored. The inputting unit 204 is an inputting apparatus that accepts an input of a command or information from the user and includes at least one of, for example, a touch sensor, a button, and a microphone. The outputting unit 205 is an outputting apparatus that outputs information to the outside and includes at least one of, for example, a display and a speaker. The communication IF 206 is an interface for communicating with a different apparatus, for example, the digital musical instrument 10 or a server apparatus (not depicted) on a network.

In this example, from among the functions of the musical piece search system 1 depicted in FIG. 2, the acquisition unit 11, the specification unit 12, the first similarity calculation unit 13, the database 14, the second similarity calculation unit 15, the integration unit 16, and the selection unit 17 are incorporated in the information processing apparatus 20. The outputting unit 18 is incorporated in the digital musical instrument 10.

In the information processing apparatus 20, a program for causing a computer apparatus to function as a user terminal in the musical piece search system 1 is stored in the storage 203. By the CPU 201 executing this program, the functions as the acquisition unit 11, the specification unit 12, the first similarity calculation unit 13, the database 14, the second similarity calculation unit 15, the integration unit 16, and the selection unit 17 are incorporated in the information processing apparatus 20. The CPU 201 that executes this program is an example of the acquisition unit 11, the specification unit 12, the first similarity calculation unit 13, the second similarity calculation unit 15, the integration unit 16, and the selection unit 17. The storage 203 is an example of the database 14. Further, in the digital musical instrument 10, the outputting unit 104 is an example of the outputting unit 18.

2. Operation 2-1. Overview

Figure 8:
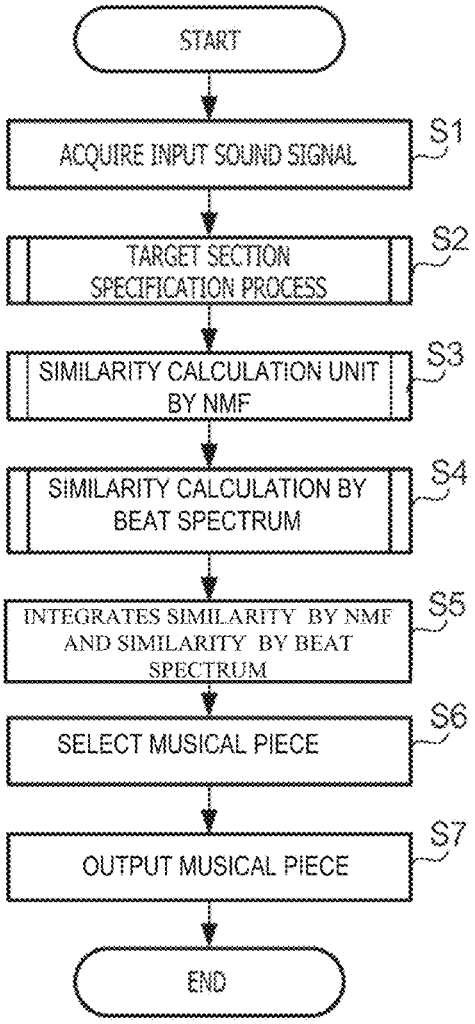
FIG. 8 is a flow chart illustrating a process for operating the musical piece search system 1.

FIG. 8 is a flow chart illustrating a process for operating the musical piece search system 1. The flow of FIG. 8 is started taking it as a trigger that, for example, the user inputs an instruction for starting of search for a musical piece. At step S1, the acquisition unit 11 acquires an input sound signal. At step S2, the specification unit 12 performs a target section specification process. At step S3, the first similarity calculation unit 13 performs similarity calculation by NMF. At step S4, the second similarity calculation unit 15 performs similarity calculation by a beat spectrum. At step S5, the integration unit 16 integrates the similarity by NMF and the similarity by a beat spectrum. At step S6, the selection unit 17 selects a musical piece on the basis of the integrated similarity. At step S7, the outputting unit 18 outputs the selected musical piece. In other words, the outputting unit 18 outputs accompaniment sound similar to the input sound. In the following, details of the individual processes are described.

2-2. Target Section Specification Process

The calculation of a similarity at steps S3 and S4 may be performed for all input sound signals. However, if all input sound signals are made a target, then this gives rise to the following problems. First, if all input sound signals are made a target, then time is required as much for the calculation. Second, the input sound signal sometimes includes, in so-called intro or outro (ending) thereof, a place that includes no rhythm, and if the similarity is calculated including also such a place, then the reliability of the similarity degrades. In the present embodiment, in order to cope with the problems, the portion that is to be made a target of similarity calculation from within the input sound signal is restricted to part of the input sound signal.

Figure 9:
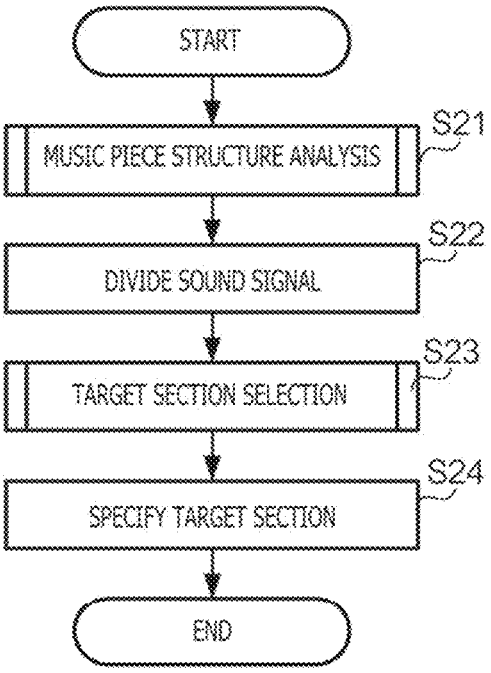
FIG. 9 is a flow chart illustrating a process for a target section specification.

FIG. 9 is a flow chart illustrating a process for a target section specification. At step S21, the specification unit 12 performs musical piece structure analysis for the input sound signal. The musical piece structure analysis is a process for analyzing a musical structure (sections such as so-called intro, melody A, melody B, chorus, or outro (ending)).

Figure 10:
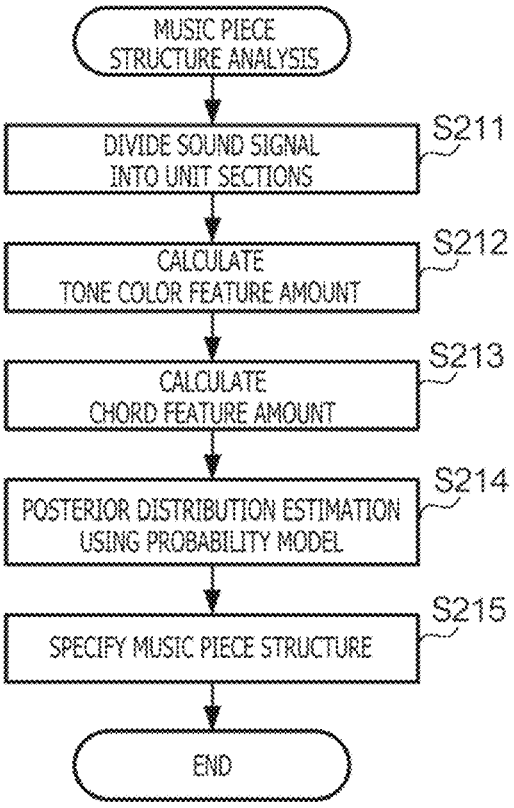
FIG. 10 is a flow chart illustrating a process for analyzing a musical piece structure.

FIG. 10 is a flow chart illustrating a process for analyzing a musical piece structure. At step S211, the specification unit 12 divides the input sound signal into a plurality of unit sections. A unit section is a section that corresponds, for example, to one measure of a musical piece. Division into unit sections is performed, for example, in the following manner. First, the specification unit 12 detects beat points in the input sound signal. Then, the specification unit 12 defines a section configured from a plurality of beat points corresponding to one measure as a unit section. For detection of beat points and definition of a section corresponding to one measure, the technology disclosed, for example, in Japan Laid-Open Patent Application No. 2015-114361 is used.

At step S212, the specification unit 12 calculates a feature amount of a tone color (hereinafter referred to as "tone color feature amount") from the input sound signal. As the tone color feature amount, for example, a predetermined number of (for example, 12) mel-frequency spectrum coefficients (MFCCs) are used. The MFCC is calculated for each unit section defined at step S211.

At step S213, the specification unit 12 calculates a feature amount of a chord (hereinafter referred to as "chord feature amount") from the input sound signal. The chord feature amount is calculated for each of frames (periods corresponding, for example, to an eighth node or a sixteenth node) into which a unit section is subdivided on the basis of the beat points. As the chord feature amount, for example, a so-called chroma vector is used. The chroma vector is obtained by separating energy in a frequency range obtained by spectrum analysis, for example, for each semitone and adding the energy pieces in one octave. If one octave is separated for each semitone, then totaling 12 sounds are obtained, and therefore, the chroma vector is a 12-dimensional vector. The chroma vectors calculated for individual frames represent a temporal change of the chord, namely, a chord progress.

At step S214, the specification unit 12 estimates a musical piece structure of the input sound by posterior distribution estimation using a probability model. In particular, the specification unit 12 estimates a probability distribution (posterior distribution) of the posterior probability when time series of a tone color feature amount and a chord feature amount are observed in regard to a probability model that describes a probability by which a time series of feature amounts is observed under a certain musical piece structure.

As the probability model, for example, a musical piece structure model, a tone color observation model, and a chord observation model are used. The musical piece structure model is a model that probabilistically describes a musical piece structure. The tone color observation model is a model that probabilistically describes a generation process of a tone color feature amount. The chord observation model is a model that probabilistically describes a generation process of a chord feature amount. In the probability models, the unit sections are grouped such that those unit sections that are similar or common in musical structure belong to a same structure section. The groups are identified by section codes (for example, A, B, C, . . . ).

The musical piece structure model is a state transition model in which, for example, a plurality of states linked to each other are arrayed in a state space, more particularly, a hidden Markov model. The tone color observation model is a probability model that follows, for example, an infinite mixed Gaussian distribution where a normal distribution is used as the probability distribution and that does not rely upon the duration in the structure section although it depends upon the section code. The chord observation model is a probability model that follows, for example, an infinite mixed Gaussian distribution where a normal distribution is used as the probability distribution and depends upon both the section code and the duration in the structure section. The posterior distribution in each probability model is estimated by an iterative estimation algorithm such as, for example, a variational Bayes method or the like. The specification unit 12 estimates a musical piece structure that maximizes the posterior distribution.

At step S215, the specification unit 12 specifies the musical piece structure on the basis of a result of the estimation at step S214.

Figure 11:
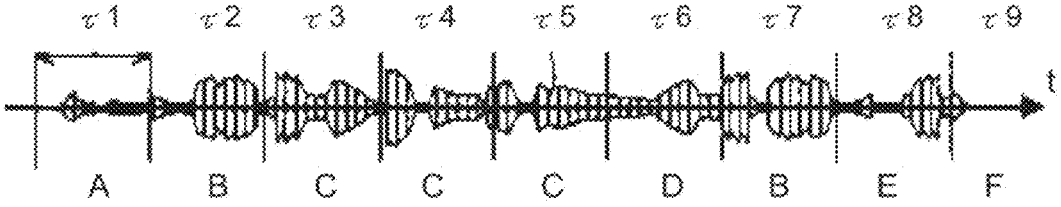
FIG. 11 is a view illustrating a musical piece structure specified in regard to an input sound signal.

FIG. 11 is a view illustrating a musical piece structure specified in regard to the input sound signal. In this example, the input sound signal is separated into nine unit sections ($\tau$1 to $\tau$9). To the unit sections, section codes of A, B, C, C, C, D, B, E, and F are allocated in order from the top.

FIG. 9 is referred to again. At step S22, the specification unit 12 divides the input sound signal. In particular, the specification unit 12 divides the input sound signal for each unit section in accordance with a result of the musical piece structure analysis. At step S23, the specification unit 12 selects a section to be used in later processing (hereinafter referred to as "target section") from within the input sound signal after divided into the plurality of sections.

Figure 12:
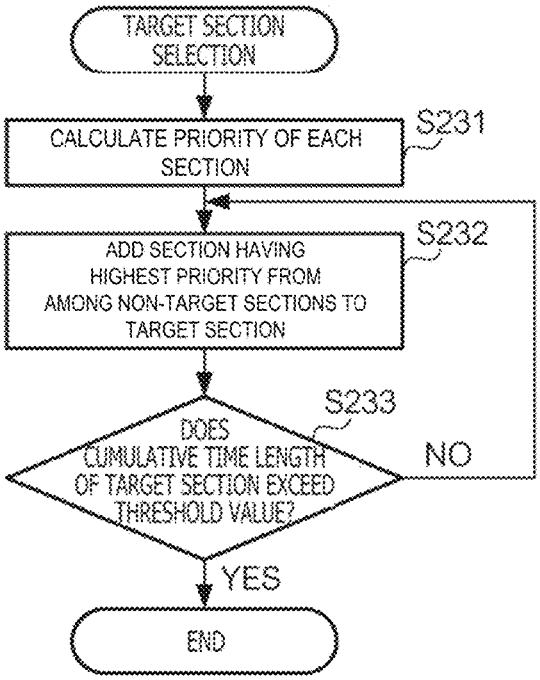
FIG. 12 is a flow chart illustrating a process for selecting a target section.

FIG. 12 is a flow chart illustrating a process for selecting a target section. At step S231, the specification unit 12 calculates a priority of each unit section. In the present example, a high priority is given to unit sections to which a same section number is allocated where the number of such unit sections is great, but a low priority is given to unit sections where the number of such unit sections is small. For example, in the example of FIG. 11, since the number of sections to which the section code C is allocated is three, the priority 3 is allocated to the three sections while the number of sections to which the section code B is allocated is two, the priority 2 is allocated to the two sections and the priority 1 is allocated to any other section. In other words, at step S23, a section that is to be made a target of calculation of the rhythm similarity is selected in the descending order of the number of sections classified into a same group in the musical piece structure analysis from among a plurality of unit sections.

It is to be noted that the criterion for allocating a priority is not limited to that described above. Some other criterion may be used in place of or in addition to the example described above. As an example, a criterion is used by which, for example, a high priority is given to a unit section having a comparatively long time length while a low priority is given to a unit section having a comparatively short time length. In other words, at step S23 in this different example, selection of a section that is to be made a target of calculation of the rhythm similarity is performed in the descending order of the time length from among a plurality of unit sections. Although the time length in the example of FIG. 11 is equal among all unit sections, for example, in the case where the tempo changes in the middle of a piece of music or where an algorithm by which a plurality of successive unit sections are integrated in musical piece structure analysis is adopted, a criterion that provides a priority on the basis of the time length is significant. Further, as another example, a criterion may be used by which a low priority is given, according to the position of the input sound signal on a time axis, for example, to a section till a predetermined point of time after starting and another section from time by a predetermined period of time before ending to the ending while a high priority is given to the other sections. The criteria mentioned may be weighted added and applied complexly.

At step S232, the specification unit 12 adds a section having the highest priority from among the sections that have not been selected as a target section as yet (such a section is hereinafter referred to as "non-selected section") to the target sections. In the case where a plurality of sections have the highest priority, the specification unit 12 adds one section selected from among the plurality of sections in accordance with a different criterion, for example, a section having the earliest number to the target sections.

At step S233, the specification unit 12 decides whether the cumulative time length of the target sections exceeds a threshold value. As the threshold value, for example, a predetermined ratio to the overall time length of the input sound signal, as an example, 50%, is used. In the case where it is decided that the cumulative time length of the target sections does not exceed the threshold value (S233: NO), the specification unit 12 advances its processing to step S232. In the case where it is decided that the cumulative time length of the target sections exceeds the threshold value (S233: YES), the specification unit 12 ends the flow of FIG. 12.

In the example of FIG. 11, the section τ3 is added to the target sections first, and thereafter, every time processing is performed successively, the sections τ4, τ5, τ2, and τ7 are added in this order to the target sections. In this example, since the time lengths of the sections τ1 to τ9 are equal to each other, at the point of time at which the section τ7 is added to the target sections, the total number of target sections becomes 5 and the cumulative time length of the target sections exceeds 50% of the overall time length of the input sound signal.

FIG. 9 is referred to again. At step S24, the specification unit 12 specifies a target section on the basis of a result at step S23. In the example of FIG. 11, the sections τ1, τ4, τ5, τ2, and τ7 are specified as target sections. The specification unit 12 generates a signal by connecting only the target sections from within the divided input sound signal. In later processing, this signal is processed as an input sound signal.

According to this example, a portion of part selected on the basis of a musical structure of an input sound signal, for example, a section that appears repetitively, can be restricted as a target of later processing. Such a section as just described is frequently a portion having a musically high impact like a so-called chorus or melody A. By excluding a portion that may possibly be different in rhythm or tone color from the other portions like intro or outro from the target of processing, the load of processing can be reduced while the accuracy in search is maintained.

2-3. Similarity Calculation by NMF

Now, the similarity calculation by NMF at step S3 is described. Before details of the similarity calculation are described, an overview of NMF is described first. NMF is a low rank approximation algorithm that decomposes a nonnegative matrix into the product of two nonnegative matrixes. The nonnegative matrix is a matrix whose components are all nonnegative values (namely zeros or positive values). Generally, NMF is represented by the following expression (1):

[Expression 1]

$$Y \approx HU \tag{1}$$

where Y indicates a given matrix, namely, an observation matrix (m rows n columns). H is called basis matrix (m rows k columns) and U is called activation (or coefficient) matrix (k rows n columns). In other words, the NMF is a process for approximating an observation matrix Y with the product of a basis matrix H and the activation matrix U.

In order to apply the NMF to similarity calculation of a musical piece, it is supposed to use a matrix representative of an amplitude spectrogram of a sound signal as the observation matrix Y. The amplitude spectrogram represents a time variation of the frequency spectrum of a sound signal and is three-dimensional information including time, frequency, and amplitude. The amplitude spectrogram is obtained, for example, by sampling a sound signal in the time domain and taking absolute values for a complex spectrogram obtained by short time Fourier transforming the samples. Here, if the axis of abscissa is divided into n and the axis of ordinate is divided into m and then the amplitude in each of the regions obtained by the division are digitized, then the amplitude spectrogram can be represented as a matrix. This matrix includes temporal information in the row direction and frequency information in the column direction, and the value of each component includes information relating to an amplitude. Since the value of the amplitude is nonnegative, this matrix is a nonnegative matrix.

Figure 13:
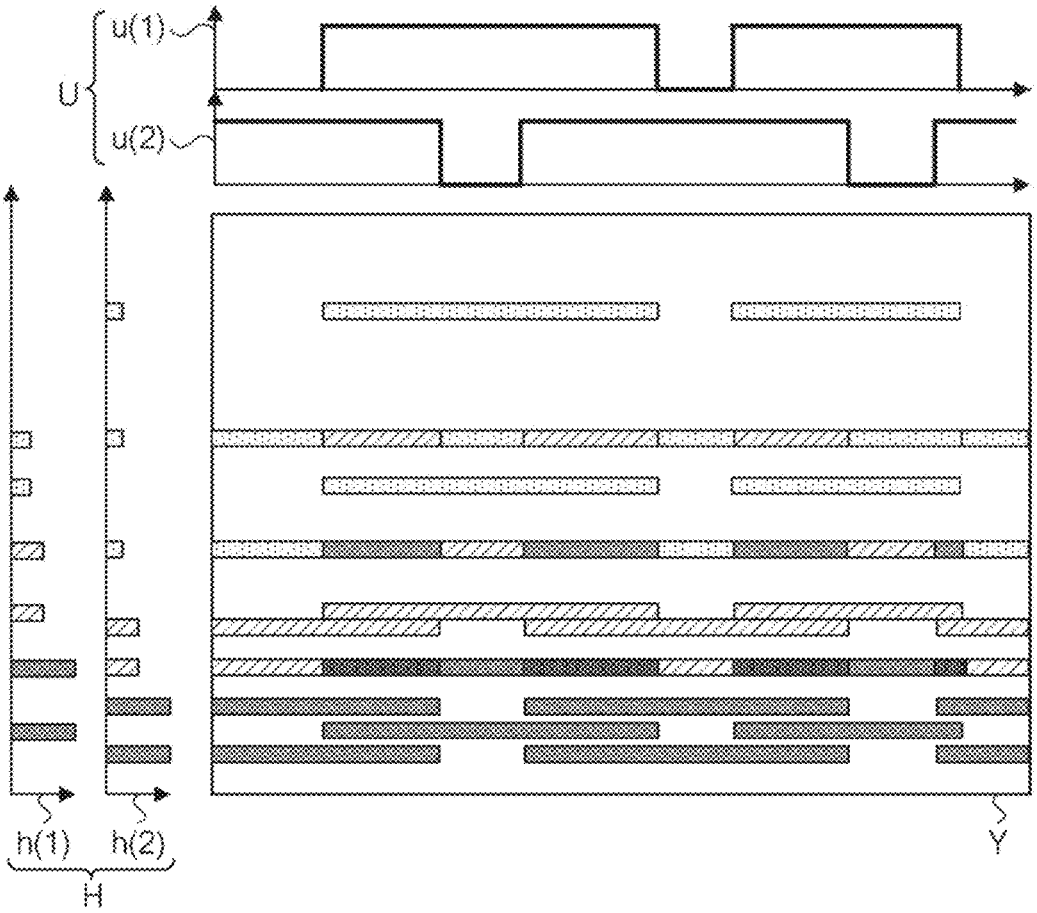
FIG. 13 is a view illustrating of NMF in regard to an amplitude spectrogram.

FIG. 13 is a view illustrating of NMF in regard to an amplitude spectrogram. FIG. 13 depicts an example in which NMF is applied to an observation matrix Y obtained from an amplitude spectrogram. The basis matrix H includes components relating to a frequency (one example of first components) and components relating to time (one example of second components) and represents a set of representative spectral patterns included in the amplitude spectrogram. It can be considered that the activation matrix U represents "at which timing" and "with which strength" the representative spectral pattern appears. More particularly, the basis matrix H includes a plurality of (in the example of FIG. 13, two) basis vectors h individually corresponding to different sound sources. Each basis vector indicates a representative frequency spectrum of a certain sound source. For example, the basis vector h(1) indicates a representative spectral pattern of the flute, and the basis spectrum h(2) indicates a representative spectral pattern of the clarinet. Further, the activation matrix U includes a plurality of (in the example of FIG. 13, two) activation vectors u corresponding to respective sound sources. For example, the activation vector u(1) represents each timing at which a spectral pattern of the flute appears and an intensity of the spectral pattern, and the activation vector u(2) represents each timing at which a spectral pattern of the clarinet appears and an intensity of the spectral pattern (in the example of FIG. 13, in order to simplify the illustration, a component of the activation vector u assumes two values of on and off).

The NMF is used to calculate a basis matrix H and an activation matrix U when the observation matrix Y is known. In particular, the NMF is defined as a problem for minimizing a distance D between the matrix Y and a matrix product HU as given by the following expression (2). As the distance D, for example, a Euclidean distance, a generalized KL distance, an Itakura Saito distance, or a β divergence is used. Although a solution to the expression (2) cannot be obtained in a closed form, several effective iterative solutions are known (for example, Lee D. D., & Sueng, H. S. (2001), Algorithms for non-negative matrix factorization. Advances in neural information processing systems, 13(1) V621-V624).

[Expression 2]

$$\underset{H,U}{\operatorname{argmin}} D(Y \| HU) \quad (2)$$

It is to be noted that the expression above signifies to calculate the matrices H and U that minimize the distance D. This similarly applies also to the expressions given hereinbelow.

It is to be noted that, in the case where musical instruments included in input sound and accompaniment sound are known to some in advance, namely, in the case where candidates for musical instruments included in input sound and accompaniment sound are restricted to some in advance, semi-supervised NMF may be applied. Such semi-supervised NMF is described, for example, in Smaragdis P, Raj B, Shashanka M V. Supervised and Semi-supervised Separation of Sounds from Single-Channel Mixtures, In: ICA. 2007. p. 414-421.

Figure 14:
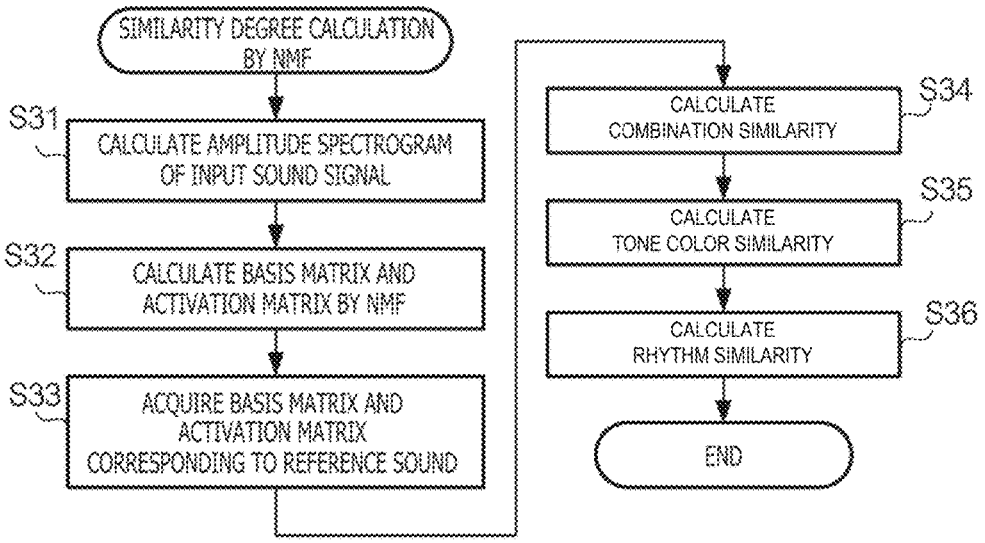
FIG. 14 is a flow chart illustrating a process for calculating similarity by NMF.

FIG. 14 is a flow chart illustrating a process for calculating similarity calculation by NMF. At step S31, the first similarity calculation unit 13 calculates an amplitude spectrogram of the input sound signal. At step S32, the first similarity calculation unit 13 applies NMF to the amplitude spectrogram of the input sound signal. In particular, the first similarity calculation unit 13 first matrixes the amplitude spectrogram of the input sound signal to obtain an observation matrix Yo. Then, the first similarity calculation unit 13 applies the NMF to the observation matrix Yo to calculate an observation basis matrix Ho (one example of a first matrix) and an observation activation matrix Uo. In other words, at step S32, a first matrix is calculated in accordance with a predetermined algorithm.

At step S33, the first similarity calculation unit 13 acquires a reference basis matrix Hr (one example of a second matrix) and a reference activation matrix Ur of the reference sound signal. In the present example, the NMF is applied in advance to each of a plurality of accompaniment data to calculate a reference basis matrix and a reference activation matrix. The calculated reference basis matrix and the reference activation matrix are recorded as information relating to accompaniment data in the database 14. The first similarity calculation unit 13 successively selects accompaniment sound to be made reference sound from among the plurality of accompaniment data recorded in the database and acquires a reference basis matrix and a reference activation matrix corresponding to the selected accompaniment sound from the database 14.

It is to be noted that the reference basis matrix and the reference activation matrix recorded in the database 14 may not necessarily have been calculated using all reference sound. The NMF may be applied only to some sections specified by a process similar to the target section specification process for the input sound to calculate a reference basis matrix and a reference activation matrix.

At step S34, the first similarity calculation unit 13 calculates a combination similarity of bases in each frame. The combination of bases is a combination of basis vectors activated within a certain period from among the plurality of basis vectors included in the basis matrix.

FIGS. 15A and 15B are a view illustrating a combination of bases. FIG. 15A is a view schematically depicting a result of the NMF corresponding to input sound, and FIG. 15B is a view schematically depicting a result of the NMF corresponding to reference sound. In this example, each of basis matrixes corresponding to the input sound and the reference sound includes basis vectors corresponding to the guitar, bass, hi-hat, snare, and bass drum. In the figure, an activation vector corresponding to each basis vector is depicted schematically. The axis of abscissa indicates time and the axis of ordinate indicates the strength of activation. If a combination of bases is viewed, then, for example, in the frame F1, the guitar, bass, hi-hat, and bass drum are activated in the input sound, and in the reference sound, the hi-hat and bass drum are activated.

A combination similarity of bases is obtained, for example, by extracting column vectors corresponding to a certain frame from an activation matrix in regard to input sound and reference sound individually, and calculating the inner product of the column vectors. This inner product indicates a combination similarity of bases in one frame. In other words, at step S34, the similarity of a combination of first components in the first matrix and the second matrix is calculated for each second component.

FIG. 14 is referred to again. At step S35, the first similarity calculation unit 13 accumulates the combination similarity s of the frames to calculate a tone color similarity between the input sound and the reference sound. In particular, at step S35, the similarity s of combinations of first components are accumulated in regard to second components to obtain a first similarity relating to tone colors of the input sound signal and the reference sound signal.

FIG. 14 is referred to again. At step S36, the first similarity calculation unit 13 calculates a rhythm similarity. In this example, a similarity of an activation vector corresponding to a particular basis vector is used as a rhythm similarity. The particular basis vector is a basis vector corresponding to a musical instrument relating to the rhythm. In particular, at step S36, a similarity in time variation of a particular first component in the first matrix and the second matrix is calculated to obtain a second similarity relating to the rhythm of the input sound signal and the reference sound signal. Further, step S36 is an example of a step at which calculation of a rhythm similarity to the reference sound signal in regard to at least some of a plurality of sections included in the input sound signal is performed. In the example of FIGS. 15A and 15B, a similarity of an activation vector corresponding to the bass drum is calculated. The processes at steps S33 to S36 are performed repetitively until the tone color similarity and the rhythm similarity are calculated in regard to all accompaniment data finally while the reference sound is successively updated.

According to this example, not only a rhythm similarity but also a tone color similarity are calculated. Accordingly, in comparison with an alternative case in which only the rhythm similarity is used, a musical piece can be searched out with a higher of accuracy.

2-4. Similarity Calculation by Beat Spectrum

Figure 16:
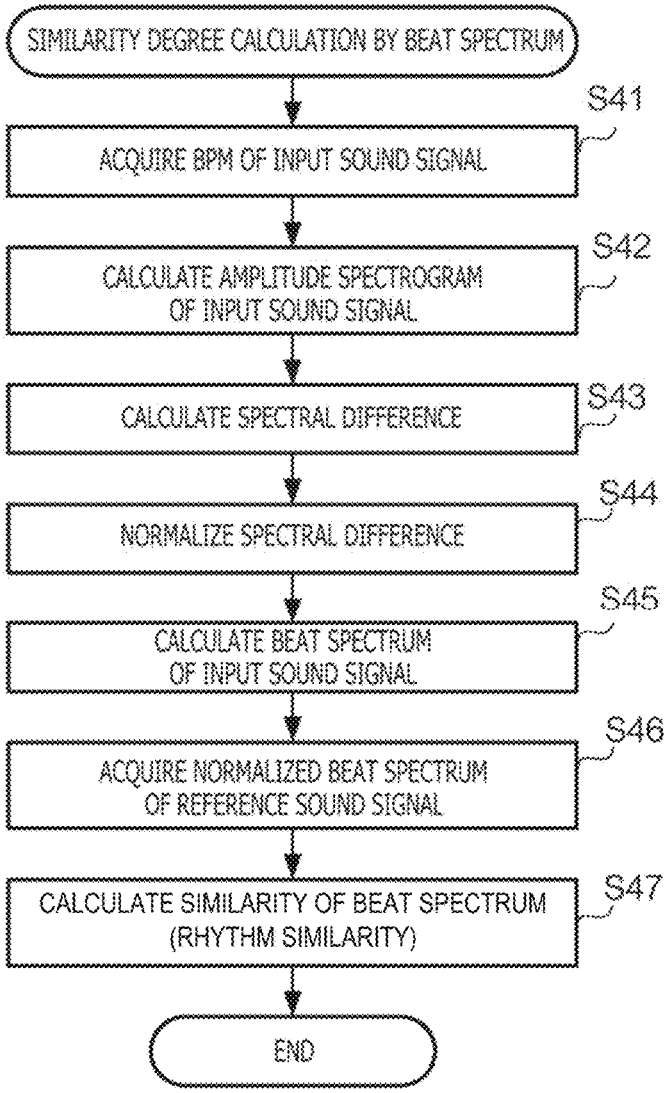
FIG. 16 is a flow chart illustrating a process for calculating similarity by a beat spectrum.

FIG. 16 is a flow chart illustrating a process for calculating of similarity calculation by a beat spectrum. The beat spectrum is feature amounts that capture repetition patterns on a spectrum and is calculated by autocorrelation in the time domain of some spectrogram-like feature amounts. In this example, the beat spectrum is calculated by autocorrelation of the spectral difference.

At step S41, the second similarity calculation unit 15 acquires BPM of the input sound signal. In this example, the second similarity calculation unit 15 calculates BPM by analyzing the input sound signal. A known technique is used for calculation of BPM. At step S42, the second similarity calculation unit 15 calculates an amplitude spectrogram of the input sound signal. At step S43, the second similarity calculation unit 15 acquires a feature amount, in this example, a spectral difference, from the amplitude spectrogram. The spectral difference is a difference in amplitude between frames adjacent each other on the time axis from the amplitude spectrogram. In other words, the spectral difference is time on the axis of abscissa and data of the amplitude different from that of the preceding frame on the axis of ordinate. At step S44, the second similarity calculation unit 15 normalizes the input sound signal with a beat number per unit time period. In particular, the second similarity calculation unit 15 normalizes the time axis of the spectral difference with the BPM. More particularly, the second similarity calculation unit 15 can normalize the time axis in a unit of 1/n by dividing the time axis of the spectral difference by n times the BPM.

At step S45, the second similarity calculation unit 15 calculates a beat spectrum of the normalized input sound signal. In particular, the second similarity calculation unit 15 calculates a beat spectrum from autocorrelation of the normalized spectral difference. At step S46, the second similarity calculation unit 15 acquires a normalized beat spectrum of the reference sound signal. In this example, a beat spectrum is calculated in advance for each of a plurality of accompaniment data. The calculated beat spectra are recorded as information relating to accompaniment data in the database 14. The second similarity calculation unit 15 successively selects accompaniment sound to be made reference sound from among the plurality of accompaniment data recorded in the database and acquires a beat spectrum corresponding to the accompaniment sound from the database 14. At step S47, the second similarity calculation unit 15 compares the normalized beat spectrum of the input sound signal and the normalized beat spectrum calculated from the reference sound signal with each other to calculate a rhythm similarity between the beat spectra of the input sound and the reference sound. In particular, the second similarity calculation unit 15 compares the similarity of the beat spectra of the input sound and the accompaniment sound. The step S47 is a different example of a step for calculating a rhythm similarity with the reference sound signal for at least some of a plurality of sections included in the input sound signal.

Figure 17A:
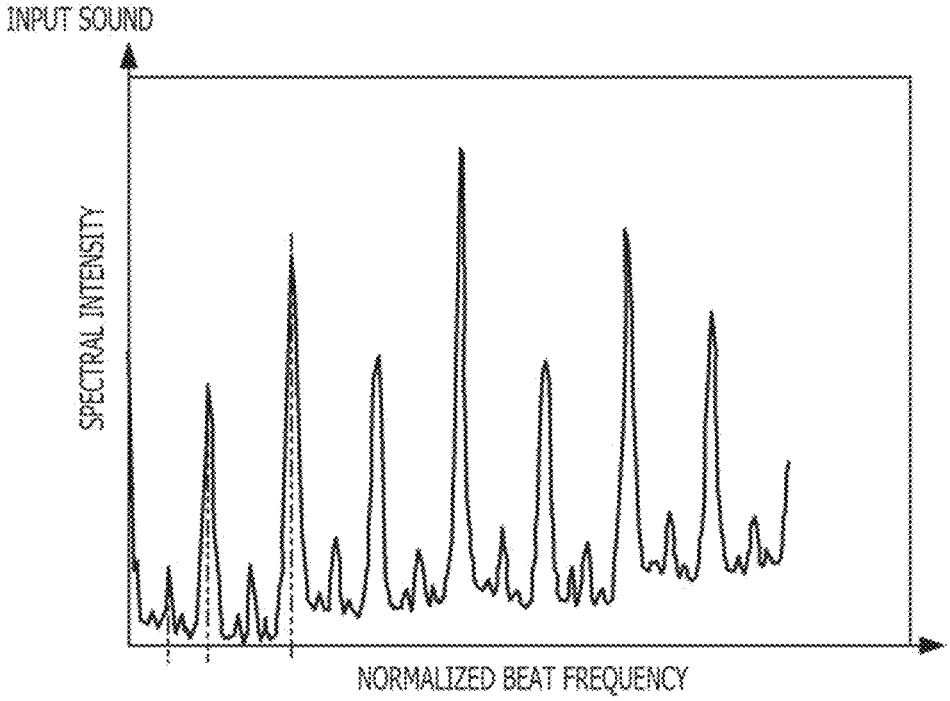
FIGS. 17A and 17B are a view illustrating a beat spectrum.
Figure 17B:
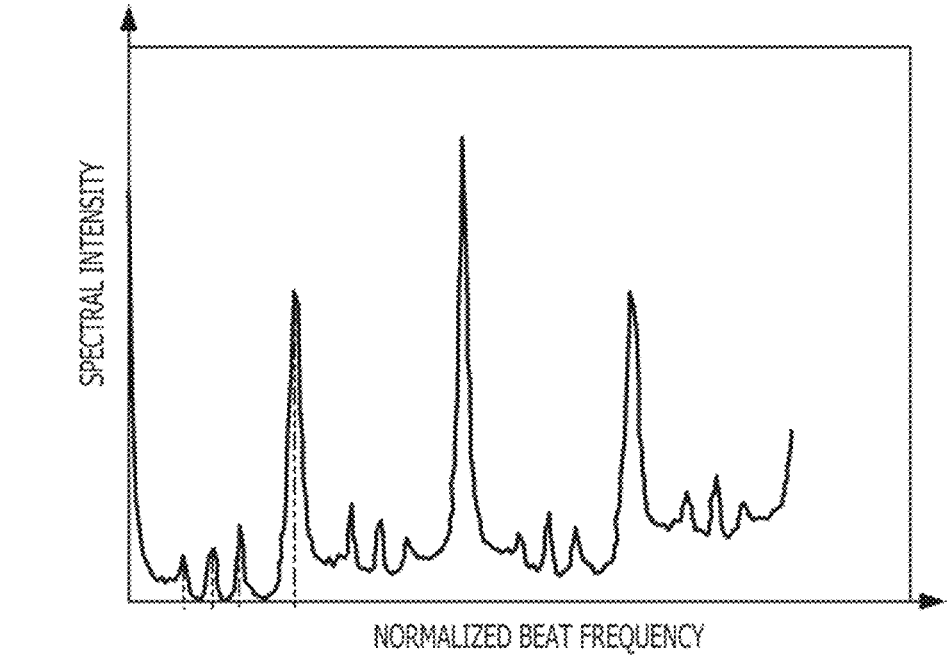

FIGS. 17A and 17B are a view illustrating a beat spectrum. FIG. 17A depicts a beat spectrum of input sound and FIG. 17B depicts a beat spectrum of reference sound. In the figures, the axis of abscissa indicates a normalized beat frequency, and the axis of ordinate indicates a spectral intensity. The second similarity calculation unit 15 performs pattern matching of the spectra to calculate a similarity of both of them. In particular, a beat spectrum is characterized by a frequency at which a peak appears and a peak intensity of the peak. The second similarity calculation unit 15 extracts, for example, in regard to each of peaks having a peak intensity equal to or higher than a threshold value, a frequency and a peak intensity of the peak as a feature amount to digitize the beat spectrum. The second similarity calculation unit 15 calculates the similarity between them using the feature amounts. The similarity is a rhythm similarity (one example of a fourth similarity). In particular, at step S47, a similarity between a beat spectrum of the input sound signal and a beat spectrum of the reference sound signal is calculated to obtain a fourth similarity regarding the rhythm.

In the similarity calculation using NMF, a rhythm similarity is calculated from an activation matrix. However, generally the NMF is insufficient in time resolution and cannot decide a difference in detailed rhythm structure such as so-called even or shuffle. Although it is possible to calculate a rhythm similarity with time analyzed more finely in the NMF, there is a problem that the calculation amount increases significantly. Further, although an example in which bases of individual musical instruments are separated clearly is depicted by the example of FIGS. 15A and 15B, as a general problem of the NMF, decomposition of musical instrument sound may not necessarily be performed. Accordingly, in the case where musical instrument sound cannot be separated well, there is a problem that the NMF cannot accurately capture a rhythm structure accurately.

In contrast, in this example, a rhythm similarity is calculated using a beat spectrum. Therefore, a detailed rhythm structure can be captured more accurately. Further, since, in a beat spectrum, generally a difference in BPM has an influence on a feature amount, even if beat spectra are merely compared with each other, it is difficult to evaluate a rhythm structure as a rhythm similarity. However, in this example, before a beat spectrum is calculated, a spectral difference is normalized with the BPM, and the difference in BPM between the input sound and the reference sound is absorbed.

2-5. Integration of Similarity s, Selection of Musical Piece

Integration of similarity s at step S5 is particularly performed in the following manner. In this example, two similarity s (tone color similarity and rhythm similarity) are obtained by NMF and one similarity (rhythm similarity) is obtained by a beat spectrum. Those similarity s are normalized to a common scale (for example, the lowest similarity is zero and the highest similarity is one).

The integration unit 16 integrates a plurality of similarity s by weighted arithmetic operation in which the similarity by NMF and the similarity by a beat spectrum are adjusted with a predetermined weight, in the present example, adjusted so as to be 1:1. In particular, the integration unit 16 calculates a similarity Di (one example of a third similarity) integrated in accordance with the following expression (3).

$$Di=2\cdot DtN+DrN+Drb \tag{3}$$

Here, DtN and DrN indicate the tone color similarity and the rhythm similarity obtained by the NMF, and Drb indicates the rhythm similarity obtained by a beat spectrum. According to this example, the similarity by NMF and the similarity by a beat spectrum are evaluated with an equal weight. The integrated similarity is calculated for each of the plurality of accompaniment data.

The selection unit 17 selects, from among the plurality of accompaniment data, accompaniment data having the highest similarity to the input sound. In this example, since the selection unit 17 is included in the information processing apparatus 20 and the outputting unit 18 is included in the digital musical instrument 10, the information processing apparatus 20 notifies the digital musical instrument 10 of an identifier of the accompaniment data selected by the selection unit 17. In the digital musical instrument 10, the outputting unit 18 reads out the accompaniment data corresponding to the notified identifier and outputs accompaniment data, namely, a musical piece.

3. Modifications

The present invention is not limited to the embodiment described hereinabove and allows various modifications. In the following, several modifications are described. Two or more of the modifications described below may be used in combination.

The corresponding relationship between the functional configuration and the hardware configuration in the musical piece search system 1 is not limited to the example described in the description of the embodiment. For example, the musical piece search system 1 may have all functions aggregated in the information processing apparatus 20. In this case, the musical piece that becomes a search target is not limited to accompaniment sound of digital musical instrument. For example, the musical piece search system 1 may be applied for search for a general musical piece content to be reproduced by a music player. Alternatively, the musical piece search system 1 may be applied for search for a musical piece in a karaoke apparatus. Further, some of the functions of the information processing apparatus 20 may be incorporated in a server apparatus on a network. For example, from among the functions of the musical piece search system 1, the specification unit 12, the first similarity calculation unit 13, the database 14, the second similarity calculation unit 15, the integration unit 16, and the selection unit 17 may be incorporated in a server apparatus. In this case, if the information processing apparatus 20 acquires an input sound signal, then it transmits a search request including the input sound signal in the form of data to the server apparatus. The server apparatus searches for a musical piece similar to the input sound signal included in the received search request and answers a result of the search to the information processing apparatus 20.

The method by the specification unit 12 for specifying a target section from an input sound signal is not restricted to the example described in the description of the embodiment. The specification unit 12 may specify a section selected from among a plurality of sections obtained by the musical piece structure analysis, for example, at random or in response to an instruction of the user as a target section. Further, the specification unit 12 is not limited to unit that performs selection of a target section until the cumulative time length of the target section exceeds a threshold value. The specification unit 12 may perform selection of a target section, for example, until the number of sections selected as a target section exceeds a threshold value. Alternatively, the specification unit 12 may perform selection of a target section until after a section having a priority higher than the threshold value does not remain any more.

The signal processing performed for a target section specified by the specification unit 12 is not limited to that performed by the first similarity calculation unit 13 and the second similarity calculation unit 15. A process other than calculation of a similarity may be performed for a target section specified by the specification unit 12.

The first similarity calculation unit 13 is not limited to unit that calculates both a rhythm similarity and a tone color similarity. The first similarity calculation unit 13 may calculate only one of a rhythm similarity and a tone color similarity. Further, in the first similarity calculation unit 13, the reference matrix acquisition unit 132 may not acquire a basis matrix and an activation matrix corresponding to a reference sound signal from the database 14 but may acquire a reference sound signal itself from the database 14 and calculate a basis matrix and an activation matrix by NMF.

One of the first similarity calculation unit 13 and the second similarity calculation unit 15 may be omitted. In this case, the integration unit 16 is unnecessary, and the selection unit 17 selects a musical piece on the basis only of a similarity by one of the first similarity calculation unit 13 and the second similarity calculation unit 15.

The acquisition unit 11, the specification unit 12, the first similarity calculation unit 13, the second similarity calculation unit 15, the integration unit 16, and the selection unit 17 are not limited to those incorporated in a computer apparatus by software. At least some of them may be incorporated as hardware, for example, by an integrated circuit for exclusive use.

A program to be executed by the CPU 201 or the like of the information processing apparatus 20 may be provided through a recording medium such as an optical disk, a magnetic disk, a semiconductor memory or the like or may be downloaded through a communication line such as the Internet. Further, the program may not necessarily include all of the steps of FIG. 8. For example, the program may include only step S1, step S2, and step S3. Further, the program may include only step S1, step S2, and step S4. Furthermore, this program may include only step S1 and step S4.

Further, the similarity calculation by a beat spectrum at step S4 may not necessarily include all steps. In the case where a spectral difference is not used as a characteristic, calculation, normalization, or autocorrelation of a spectral difference may not be performed.

The invention claimed is:

1. A sound signal processing method, comprising:

acquiring a beat number per unit time period from an input sound signal;

executing a normalization process for normalizing the input sound signal with the beat number per unit time period;

calculating a rhythm similarity between a beat spectrum of the normalized input sound signal and a normalized beat spectrum calculated from a reference sound signal;

calculating a similarity between the input sound signal and the reference sound signal using nonnegative matrix factorization; and integrating the rhythm similarity and the calculated similarity.

2. A sound signal processing method, comprising:

acquiring a beat number per unit time period from an input sound signal;

calculating an amplitude spectrogram of the input sound signal;

calculating a spectral difference that is a difference in amplitude between adjacent frames on a time axis from the amplitude spectrogram;

executing a normalization process for normalizing the input sound signal with the beat number per unit time period, wherein in the normalization process, the time axis of the spectral difference is normalized with a beat number per unit time period; and calculating a rhythm similarity between a beat spectrum of the normalized input sound signal and a normalized beat spectrum calculated from a reference sound signal.

3. The sound signal processing method according to claim 2, wherein in the normalization process, the time axis of the spectral difference is divided by n times the beat number per unit time period to normalize the time axis into 1/n beat units.

4. The sound signal processing method according to claim 2, wherein at the calculating of the rhythm similarity, the beat spectrum is calculated from autocorrelation of the normalized spectral difference.

5. A sound signal processing apparatus, comprising:

an information processing apparatus having an acquisition unit, a beat number acquisition unit, a normalization unit, a beat spectrum calculation unit, a rhythm similarity calculation unit, a first similarity calculation unit, and an integration unit;

the acquisition unit being configured to acquire an input sound signal;

the beat number acquisition unit being configured to acquire a beat number per unit time period from the input sound signal;

the normalization unit being configured to normalize the input sound signal with the beat number per unit time period;

the beat spectrum calculation unit being configured to calculate a beat spectrum of the normalized input sound signal;

the rhythm similarity calculation unit being configured to calculate a rhythm similarity between the beat spectrum of the normalized input sound signal and a normalized beat spectrum calculated from a reference sound signal;

the first similarity calculation unit being configured to calculate a similarity between the input sound signal and the reference sound signal using nonnegative matrix factorization; and the integration unit being configured to integrate the rhythm similarity and the calculated similarity.

6. A sound signal processing apparatus, comprising:

an information processing apparatus having an acquisition unit, a beat number acquisition unit, a normalization unit, a beat spectrum calculation unit, a rhythm similarity calculation unit, a similarity calculation unit, and an integration unit the acquisition unit being configured to acquire an input sound signal the beat number acquisition unit being configured to acquire a beat number per unit time period from the input sound signal;

the similarity calculation unit being configured to:

calculate an amplitude spectrogram of the input sound signal; and calculate a spectral difference that is a difference in amplitude between adjacent frames on a time axis from the amplitude spectrogram;

the normalization unit being configured to normalize the input sound signal with the beat number per unit time period, wherein in the normalization process, the time axis of the spectral difference is normalized with a beat number per unit time period; and the rhythm similarity calculation unit being configured to calculate a rhythm similarity between a beat spectrum of the normalized input sound signal and a normalized beat spectrum calculated from a reference sound signal.

7. The sound signal processing apparatus according to claim 6, wherein the normalization unit being further configured to divide the time axis of the spectral difference by n times the beat number per unit time period to normalize the time axis into 1/n beat units.

8. The sound signal processing apparatus according to claim 6, wherein the rhythm similarity calculation unit being further configured to calculate the beat spectrum of the normalized input sound signal from autocorrelation of the normalized spectral difference.

* * * * *